US008070073B2

(12) United States Patent
Ciloglu et al.

(10) Patent No.: US 8,070,073 B2
(45) Date of Patent: Dec. 6, 2011

(54) COMPOSITE RAIL JOINT END POST

(75) Inventors: Korhan Ciloglu, Monroeville, PA (US); Sidney Shue, Canonsburg, PA (US)

(73) Assignee: L.B. Foster Company, Pittsburgh, PA (US)

( * ) Notice: Subject to any disclaimer, the term of this patent is extended or adjusted under 35 U.S.C. 154(b) by 0 days.

(21) Appl. No.: 12/712,763

(22) Filed: Feb. 25, 2010

(65) Prior Publication Data

US 2010/0213269 A1 Aug. 26, 2010

Related U.S. Application Data

(60) Provisional application No. 61/155,478, filed on Feb. 25, 2009.

(51) Int. Cl.
*E01B 1/00* (2006.01)

(52) U.S. Cl. ..... 238/152; 238/153

(58) Field of Classification Search ..... 238/229, 238/152, 153, 382, 283
See application file for complete search history.

(56) References Cited

U.S. PATENT DOCUMENTS

| | | | | |
|---|---|---|---|---|
| 1,474,459 | A | 11/1923 | Wolhaupter | |
| 3,100,080 | A | 8/1963 | Fiechter | |
| 3,381,892 | A | 5/1968 | Eisses | |
| 3,727,838 | A | 4/1973 | Bergh | |
| 4,773,590 | A | 9/1988 | Dash et al. | |
| 2005/0098646 | A1 | 5/2005 | Urmson et al. | |
| 2007/0272762 | A1 * | 11/2007 | Click et al. | 238/14.05 |

FOREIGN PATENT DOCUMENTS

| | | | |
|---|---|---|---|
| CN | 200996118 | Y | 12/2007 |
| EP | 1 164 222 | A1 | 12/2001 |
| FR | 1 365 416 | A | 7/1964 |
| JP | 09151407 | A | 6/1997 |

OTHER PUBLICATIONS

PCT/ISA/220 Notification of Transmittal of The International Search Report and The Written Opinion of the International Searching Authority, or The Declaration, dated May 17, 2010, concerning PCT/US2010/025407.

PCT/ISA/210 International Search Report dated May 17, 2010, concerning PCT/US2010/025407.

PCT/ISA/237 Written Opinion of the International Searching Authority dated May 17, 2010, concerning PCT/US2010/025407.

Database WPI, Week 200825, Thomson Scientific, London, GB, AN 2008-D35428, XP002579587, Dec. 25, 2007.

* cited by examiner

*Primary Examiner* — Mark Le

(74) *Attorney, Agent, or Firm* — Thorp Reed & Armstrong, LLP

(57) ABSTRACT

An end post for a rail joint assembly comprising: a top portion having a profile substantially identical to cross-sectional shapes of rail head sections of first and second rails of the rail joint assembly; a base; and a stem disposed between the top portion and the base; wherein one or more of the top portion, base and stem comprise a plurality of pieces of a first electrically insulating material disposed on or in a second electrically insulating material. The plurality of pieces are preferably spaced apart and may have a substantially disc-shape or a substantially cylindrical-shape, and are preferably made from a ceramic material such as zirconium dioxide, aluminum oxide or silicon nitride, where the second electrically insulating material comprises a polymeric material, such as polyurethane.

13 Claims, 3 Drawing Sheets

COMPOSITE RAIL JOINT END POST

CROSS REFERENCE TO RELATED APPLICATIONS

This application claims the benefit of provisional patent application U.S. Ser. No. 61/155,478 filed Feb. 25, 2009, by the present inventors, which is incorporated by reference herein.

TECHNICAL FIELD OF THE INVENTION

This invention relates to an end post construction for use in an insulated rail joint assembly typically used in a railway or railroad track system.

BACKGROUND

Field of the Disclosure

A rail joint assembly connects adjacent rail sections together by mechanically splicing the rail ends. Prior art joint assemblies typically involve joint bars placed along the rails across the joint, on either side of the webs and secured by glue and/or bolts. A separator such as an end post, a gasket or other spacer may be placed between the rail ends. Reinforcing fiberglass cloth may be placed into the bond line between the rail ends and between the joint bar and rail to strengthen and insulate the joint.

Some applications require electrical insulation through the rail joint, such as for signaling, broken rail detection, track movement or train location purposes. In those applications, insulating materials are used as separators between the rail ends, and may be also used to separate the joint bars from the rails.

One typical rail joint assembly is described in U.S. Pat. No. 3,100,080 to Fiechter which discloses a fishplate bonded to either side of a rail web, with a through-bolt securing the entire arrangement. The rail is supported on a tie, with a tie plate between the tie and the base of the rail. U.S. Pat. No. 3,381,892 to Eisses discloses another typical insulating rail joint assembly configuration, having a fishplate on either side of a rail web, with an insulating paste between the web and each fishplate. In addition, U.S. Pat. No. 4,773,590 to Dash et al., teaches the use of polyurethane or fiberglass end posts as part of an insulated rail joint assembly. Further, U.S. Pat. No. 3,727,838 to Bergh teaches an electrically insulating rail joint end post having steel face plates and at least one high compressive strength thin insulating ceramic spacer sheet adhesively bonded on each face to steel face plates or steel filler plates and where at least the edges of the end post are peripherally protected by a nonconducting polymeric coating, conveniently by coating of the entire end post.

The prior art arrangements give rise to certain difficulties particularly where end posts made of elastomeric materials are used in the middle of an insulated rail joint. In such a conventional insulated rail joint, the end post is not designed to carry structural loading and generally only serves as an insulating spacer. This is mainly due to the lack of insulating materials that are structurally capable of handling complex loading in the railroad track. Rail heads tend to flow under repeated loading due to the discontinuity along the rail in a joint. Discontinuity in the rail amplifies impact loads and bending stresses which in turn shorten the life of insulated rail joints. Additionally, such discontinuity also creates maintenance headaches for the railroads, because it requires periodic inspection and grinding of the rail head area.

Accordingly, it would be desirable to provide an insulating rail joint assembly employing an end post exhibiting mechanical behavior similar to steel to prevent rail head flow and thereby increase the life of the rail joint while reducing maintenance requirements for the rail joint. Furthermore, the most common initiation point of deterioration leading to product failure in insulated rail joints is the area under the rail head. This area is highly stressed during dynamic wheel loading and the main cause of these high dynamic stresses is the end post's inability to carry compression loads in the rail head area during dynamic loading. Thus, it would be desirable to provide an end post with compressive load carrying capacity that reduces the dynamic stresses generated in this area which would lead to better insulated rail performance and longer service life.

These and other advantages of the invention will be appreciated by reference to the detailed description of the preferred embodiment(s) that follow.

SUMMARY OF THE INVENTION

In a first aspect, the present invention comprises an end post for a rail joint assembly comprising: a top portion having a profile substantially identical to cross-sectional shapes of rail head sections of first and second rails of the rail joint assembly; a base; and a stem disposed between the top portion and the base; wherein one or more of the top portion, base and stem comprise a plurality of pieces of a first electrically insulating material disposed on or in a second electrically insulating material. Preferably, each of the plurality of pieces may be spaced apart in the second electrically insulating material. Also, each of the plurality of pieces preferably may be substantially disc-shaped or a shape selected from the group consisting of hexagonal, cylindrical, oval, an irregular disc-like shape, spherical and sphere-like. Further, the first electrically insulating material may preferably comprise a ceramic material and the second electrically insulating material may preferably comprise a polymeric material.

In another aspect of the end post of the present invention, the first electrically insulating material comprises a ceramic material and the second electrically insulating material comprises a polymeric material. Further, the first electrically insulating material may preferably be selected from the group consisting of zirconium dioxide (zirconia), aluminum oxide and silicon nitride and/or the second electrically insulating material preferably may comprise a polyurethane.

In yet another aspect of the end post of the present invention, each of the plurality of pieces preferably may further comprise an aramid fiber material disposed on or in the first electrically insulating material. Additionally, the first electrically insulating material preferably may be selected from the group consisting of zirconium dioxide (zirconia), aluminum oxide and silicon nitride and the second electrically insulating material may preferably comprise a polyurethane.

In a further aspect of the end post of the present invention, a surface activation agent is preferably included for enhancing bonds between the substantially disc-shaped pieces and the polymeric material. Furthermore, the surface activation agent may preferably comprise a polysilane.

In an additional aspect, the present invention comprises an end post for a rail joint assembly comprising: a top portion having a profile substantially identical to cross-sectional shapes of rail head sections of first and second rails of the rail joint assembly; a base; and a stern disposed between the top portion and the base; wherein the top portion, stern and base comprise an integral casting of a polymeric material or a fiberglass material and wherein a plurality of substantially disc-shaped ceramic pieces are disposed on or in the top portion and base. Preferably, each of the plurality of substantially disc-shaped pieces may be spaced apart from each other. A plurality of substantially disc-shaped, spaced apart ceramic pieces preferably may also be disposed in the stem. Moreover, the end post preferably may further comprise a surface activation agent, such as a polysilane, for enhancing bonds between the substantially disc-shaped ceramic pieces and the polymeric material or fiberglass material. Further, each of the plurality of substantially disc-shaped ceramic pieces preferably may be made from a material selected from the group consisting of zirconium dioxide, aluminum oxide and silicon nitride and the polymeric material preferably may comprise a polyurethane.

In a further aspect, the end post of the present invention preferably may further comprise an aramid fiber material disposed on or in each of the plurality of substantially disc-shaped ceramic pieces.

In another aspect of the end post of the present invention, one or more of the top portion, stem and base have first and second faces preferably covered by a layer of an aramid fiber material.

BRIEF DESCRIPTION OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
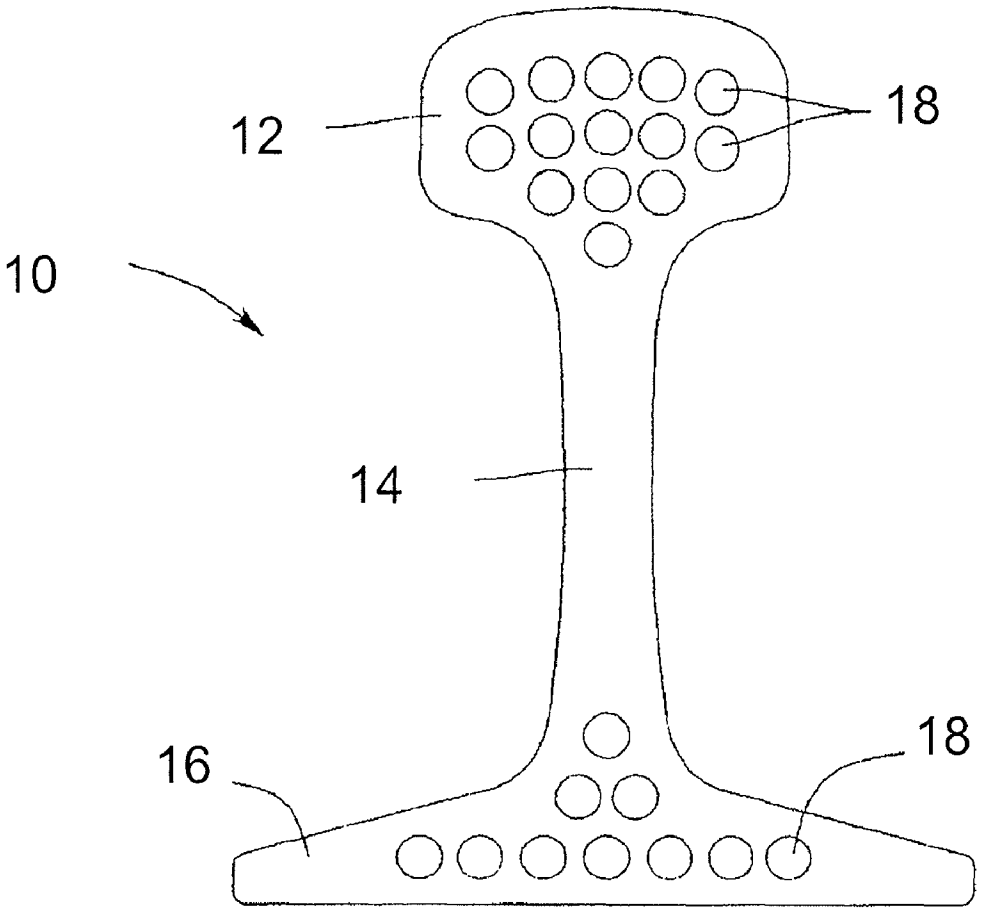
FIG. 1 is a front elevational view of an end post according to another preferred embodiment of the present invention.
Figure 2:
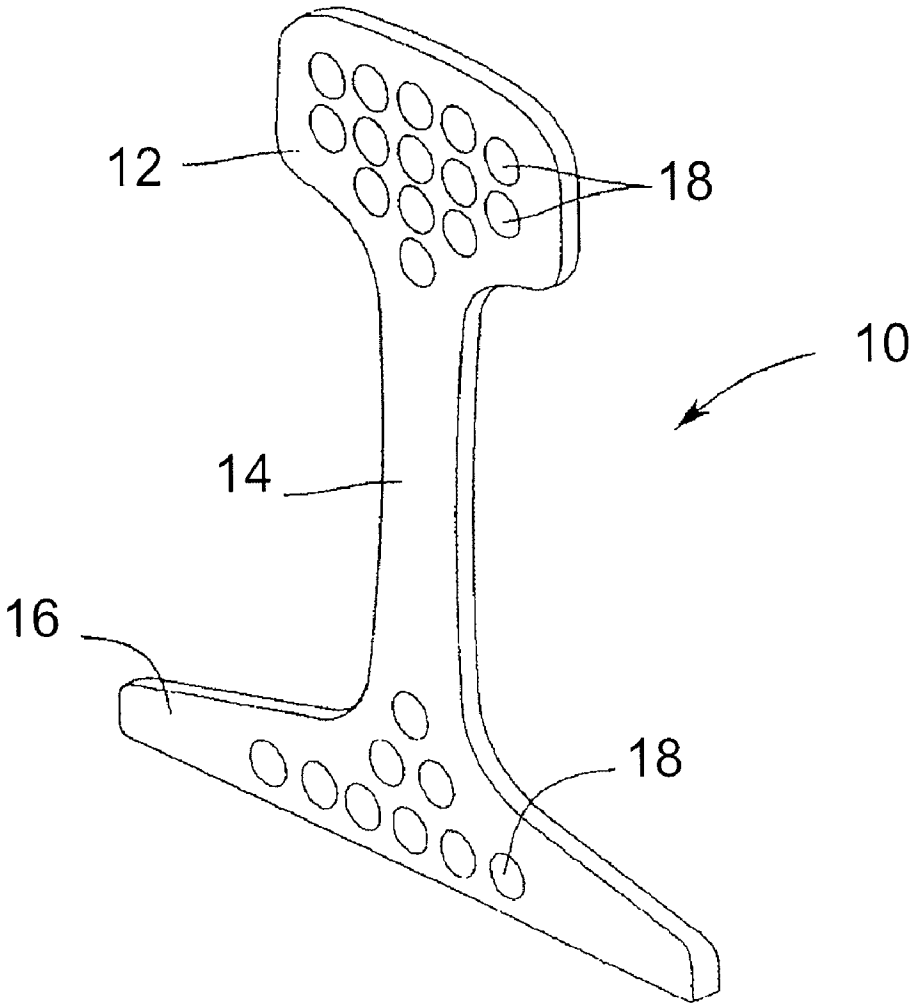
FIG. 2 is a perspective view of the end post of FIG. 1.
Figure 3:
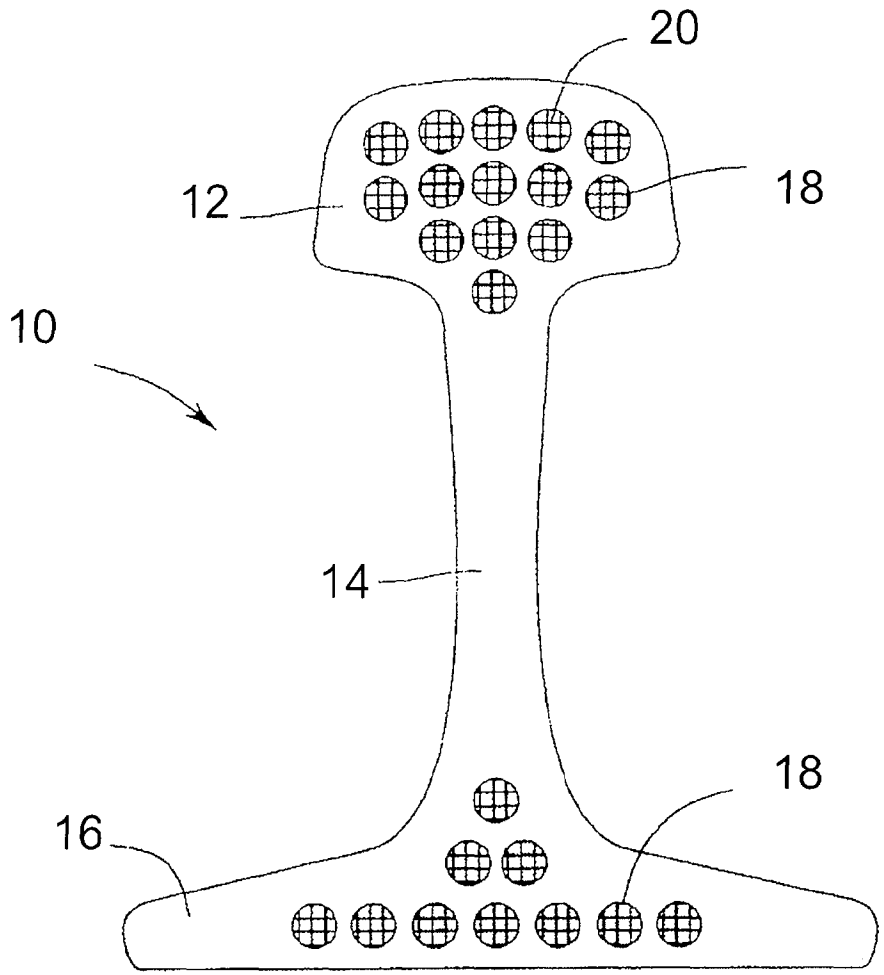
FIG. 3 is another front elevational view of the end post of FIG. 1.

FIGS. 1-3 illustrate an end post 10 according to a preferred embodiment of the present invention wherein top portion 12, middle stem 14 and base 16 are preferably made from a elastomeric or polymeric material such as plastics in general and including elastomers such as polyurethane and/or other suitable materials. If a rigid end post 10 is desired instead of an elastomeric one, G10 fiberglass material is preferably used to construct end post 10. Both elastomeric and rigid G10 fiberglass materials are commercially available for use in end posts 10. Additionally, the polymeric or elastomeric material of end post 10 serves as a matrix for the incorporation of different materials in the top portion 12 and in the base 16 to provide compression strength to the end post. Preferably, this different material may comprise cylindrical or disc-shaped pieces 18 or other suitably shaped pieces of a second electrically insulating material, such as a ceramic material which may comprise zirconium dioxide or zirconia ($ZrO_2$), aluminum oxide or alumina ($Al_2O_3$) or silicon nitride ($Si_3N_4$). Pieces 18 may also be made from other electrically insulating materials suitable for providing the requisite compression strength. Additionally, pieces 18 may comprise or define other shapes such as hexagonal or an irregular disc-like cylinder shape or sphere or sphere-like shapes. Preferably, pieces 18 have a thickness of about 0.220 inches providing for a preferred final thickness of end post 10 of about 0.25 inches when a protective fabric is used between the ends of rail and ceramic pieces 18. Pieces 18 preferably are about ⅜" in diameter and placed about ⅜" away from the outer contour of end post 10 to prevent their contact with train wheels and accommodate standard rail grinding practices.

The composite construction of top portion 12 and base 16 comprising the ceramic pieces 18 arrayed in the polymeric or elastomeric material is used to overcome potential shortcomings that may be associated with larger sheets or pieces of relatively brittle materials such as ceramics which tend to exhibit an uncontrollable progression of failure where a fracture causing the failure may be arrested in a very short distance making the failure appear in the form of "chipping" of small particles or the same fracture may run across the full section of a part causing an immediate and complete failure. While not shown in the drawings, such composite construction of pieces 18 in top portion 12 and base 16 may also be employed in stem 14. The composite construction of end post 10 thus provides redundancy such that even if one or more individual pieces 18 fail completely, the failure will be contained in those particular pieces 18 and a complete failure of all ceramic pieces 18 will be avoided.

In another preferred embodiment of the present invention, pieces 18 may be covered by layer 20 of Kevlar® or other aramid fiber based fabric or equivalent to provide additional strength and protection for pieces 18. Such aramid fiber fabrics are highly durable materials and serve to provide a cushion to protect the smooth surfaces of the pieces 18 from the rough steel surfaces of the abutting rail ends of the rail joint assembly.

Preferably, an array of pieces 18 is first preassembled onto a solid or mesh sheet of aramid fiber material such as Kevlar® fabric in a certain configuration to fit the geometry of end post 10. In this manner, the entire outer surfaces of one or both faces of top portion 12, stem 14 and/or base 16 may be covered by an aramid fiber material such as Kevlar.® Another option is to cover the contact surfaces of individual pieces 18 with Kevlar,® but Kevlar® fabric is difficult to work with in small sizes. Thus, the preassembled pieces 18 on the Kevlar® material are preferably placed in a mold conforming to the geometry of end post 10 and polyurethane material is cast therein. There are shortcomings with an open mold casting process, because polyurethane doesn't flow thorough all of the geometrical features of the molded part and result in hollow sections. These shortcomings can be avoided by pouring polyurethane in multiple steps to cover certain areas in batches, but this approach may not be feasible for large scale manufacturing. Therefore, molding of end posts 10 under vacuum may be preferred to ensure full penetration of polyurethane throughout the composite parts of end post 10. Further, the bonding between ceramic pieces 18 and the elastomeric matrix of end post 10 preferably is enhanced by surface activation agents, such as polysilanes.

In yet another preferred embodiment, the end post 10 preferably is constructed by drilling openings in one or more of the top portion 12, stem 14 and base 16 of a areas of a previously manufactured end post 10, preferably made of elastomeric or fiberglass material, so as to create interference fits between ceramic pieces 18 inserted into such openings. Ceramic beads, with or without an epoxy, preferably are then inserted over ceramic pieces 18 and/or in between each of the ceramic pieces 18 and the boundary of its respective opening. This method of manufacture lends itself well to the case where no fabric protection layer 20 is incorporated into the construction of end post 10.

Further, end post 10 may comprise a single piece construction or a multi-piece construction where T-shaped or other suitably shaped keys (not shown) are preferably employed to create mechanical interference fits between the top section 12 and the stem 14 and also between the stem 14 and the base 16. Bonding or other known techniques may also be used, alone or in addition to the mechanical interference fits, to assemble end post 10 from the top section 12, stem 14 and base 16 components.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. An end post for a rail joint assembly comprising:

a top portion having a profile substantially identical to cross-sectional shapes of rail head sections of first and second rails of the rail joint assembly;

a base; and a stem disposed between the top portion and the base;

wherein one or more of the top portion, base and stem comprise a plurality of pieces of a first electrically insulating material disposed on or in a second electrically insulating material;

wherein each of the plurality of pieces is substantially disc-shaped or substantially cylindrical-shaped;

wherein the first electrically insulating material comprises a ceramic material and the second electrically insulating material comprises a polymeric material; and a surface activation agent for enhancing bonds between each of the plurality of the substantially disc-shaped pieces and the polymeric material.

2. The end post of claim 1 wherein the surface activation agent comprises a polysilane.

3. An end post for a rail joint assembly comprising:

a to portion having a profile substantially identical to cross-sectional shapes of rail head sections of first and second rails of the rail joint assembly;

a base; and a stem disposed between the top portion and the base;

wherein one or more of the top portion, base and stem comprise a plurality of substantially disc-shaped pieces of a first electrically insulating material disposed on or in a second electrically insulating material;

wherein each of the plurality of pieces further comprises an aramid fiber material disposed on or in the first electrically insulating material; and a surface activation agent for enhancing bonds between each of the plurality of pieces and the second electrically insulating material.

4. The end post of claim 3 wherein the surface activation agent comprises a polysilane.

5. An end post for a rail joint assembly comprising:

a top portion having a profile substantially identical to cross-sectional shapes of rail head sections of first and second rails of the rail joint assembly;

a base; and a stem disposed between the top portion and the base;

wherein the top portion, stem and base comprise an integral casting of a polymeric material or a fiberglass material and wherein a plurality of substantially disc-shaped ceramic pieces are disposed on or in the top portion and base.

6. The end post of claim 5 wherein the plurality of substantially disc-shaped ceramic pieces are spaced apart from each other.

7. The end post of claim 5 wherein a plurality of substantially disc-shaped, spaced apart ceramic pieces are disposed in the stem.

8. The end post of claim 5 further comprising an aramid fiber material disposed on or in each of the plurality of substantially disc-shaped ceramic pieces.

9. The end post of claim 5 wherein one or more of the top portion, stem and base have first and second faces covered by a layer of an aramid fiber material.

10. The end post of claim 7 wherein one or more of the top portion, stem and base have first and second faces covered by a layer of an aramid fiber material.

11. The end post of claim 5 further comprising a surface activation agent for enhancing bonds between the substantially disc-shaped ceramic pieces and the polymeric material or fiberglass material.

12. The end post of claim 11 wherein the surface activation agent comprises a polysilane.

13. The end post of claim 5 wherein each of the plurality of substantially disc-shaped ceramic pieces is made from a material selected from the group consisting of zirconium dioxide, aluminum oxide and silicon nitride and the polymeric material comprises a polyurethane.

* * * * *